US005899000A

United States Patent [19]

Break et al.

[11] Patent Number: 5,899,000

[45] **Date of Patent: * May 4, 1999**

[54] HAND HELD CUTTER

[76] Inventors: Douglas G. Break, Livonia; Arthur B. Chubb, Romulus, both of Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,472

[22] Filed: Oct. 30, 1996

[51] Int. Cl.[6] ..... B26B 13/00; B26B 25/00

[52] U.S. Cl. ..... 30/240; 30/265; 30/292; 30/294; 83/485

[58] Field of Search ..... 30/240, 265, 280, 30/292, 294, 306, 307, 319; 83/436.3, 436.8, 436.9, 485, 487, 488

[56] References Cited

U.S. PATENT DOCUMENTS

| | | | |
|---|---|---|---|
| 796,708 | 8/1905 | Conkling | 30/265 |
| 982,743 | 1/1911 | Potstada | 30/265 |
| 1,098,671 | 6/1914 | Lundy | 30/265 X |
| 1,474,856 | 11/1923 | Starkl | 30/265 |
| 1,720,305 | 7/1929 | Tjernlund | 30/265 |
| 2,861,340 | 11/1958 | Hazzard | 30/240 X |
| 3,120,777 | 2/1964 | Genin | 83/436.3 X |
| 3,710,444 | 1/1973 | Fishman | 30/265 |
| 3,710,445 | 1/1973 | Roth | 30/240 X |
| 4,020,550 | 5/1977 | Okada | 30/292 X |
| 4,283,853 | 8/1981 | Fazzini | 30/265 |
| 4,557,132 | 12/1985 | Break . | |
| 4,766,757 | 8/1988 | Break et al. . | |
| 5,353,620 | 10/1994 | Olsen et al. . | |
| 5,505,069 | 4/1996 | Break et al. . | |

OTHER PUBLICATIONS

Other Tapco Products 1989 Tapco Products Company, Inc. Roller Cutter Hand Held Slitting Tool 1988 Tapco Products Company, Inc.

*Primary Examiner*—Eugenia A. Jones

[57] ABSTRACT

A hand held cutter which is self guiding and includes a roller with a resilient workpiece contacting surface and is rotatably mounted adjacent each pair of cutting rolls on a cutting roll supporting body. When the cutting roll supporting body is pulled or pushed across a sheet to be cut, the rollers frictionally engages the upper and lower surfaces of the sheet and tend to guide the cutter in a straight line.

4 Claims, 3 Drawing Sheets

HAND HELD CUTTER

FIELD OF THE INVENTION

This invention relates to a hand held cutter for cutting sheet materials and particularly sheet metal.

BACKGROUND AND SUMMARY OF THE INVENTION

In one common type of tool used for cutting sheet material, a hand held cutter is used wherein a body supports a pair of opposed cutting rolls and is pulled through a sheet. One of the problems with such a cutter is that the user must be careful to move the cutter in a straight line.

Among the objectives of the present invention are to provide a hand held cutter which is self guiding; which can be manufactured at low cost; and which minimizes the problem with prior cutters.

In accordance with the invention, a roller with a resilient workpiece contacting surface is rotatably mounted adjacent each of the cutting rolls. When the cutting roll supporting body is pulled or pushed across a sheet to be cut, the rollers frictionally engages the upper and lower surfaces of the sheet and tend to guide the cutter in a straight line.

DESCRIPTION OF THE PREFERRED EMBODIMENTS

Figure 1:
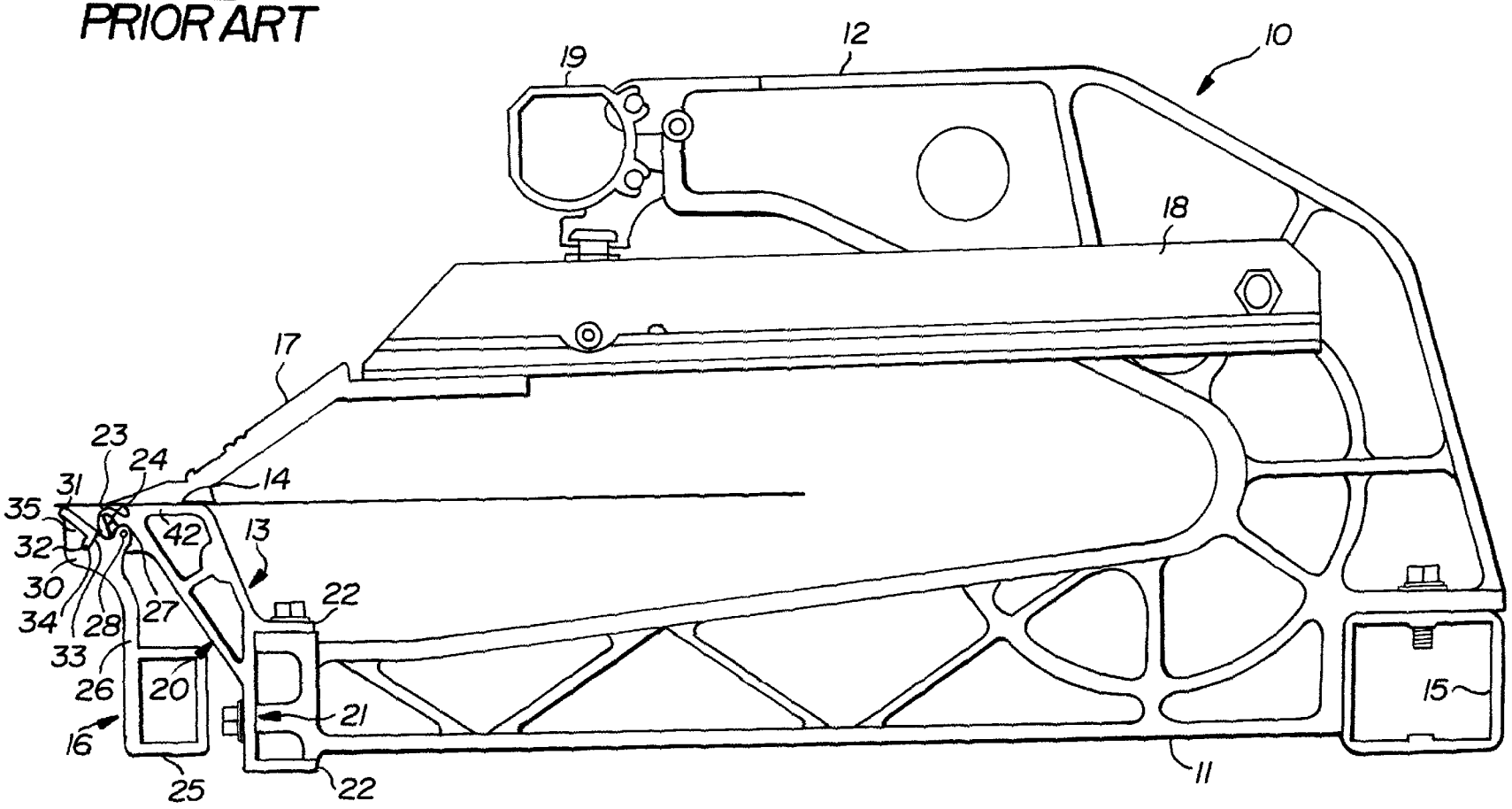
Fig-1 PRIOR ART
FIG. 1 is a side elevational view showing a sheet bending brake in connection with a hand held cutter embodying the invention that can be used.

Referring to FIG. 1, the sheet bending brake to which the invention can be applied comprises longitudinally spaced C-shaped frame members 10. Each frame member 10 includes a lower arm 11 and an upper arm 12 which overlies the lower arm 11 in spaced relation thereto. Legs may be provided as needed to support the brake above the floor or working area.

A first extruded fixed member 13 is fixed on the ends of the free lower arms 11 and defines a clamping surface 14. Longitudinally spaced base rails 15 are fixed to the rear end of the lower arms 11. A second extruded bending member 16 is hinged to the first member 13, as presently described, to provide a means for bending the sheet material.

Clamping member 17 extends longitudinally in overlying relationship to the clamping surface 14 of the first member 13. Means are provided for moving the anvil member toward and away from the clamping surface to clamp a workpiece on the clamping surface. The means for clamping the workpiece may comprise channel shaped pivot bars 18 pivoted on each frame member 10 with the clamping member 17 fixed thereto and handle member 19 pivoted to the upper arm 12 of each C-frame member 10 and to pivot bars 18 by a plurality of extensible links pivoted at the upper edge to the handle member 19 and at the lower end to the pivot bars 18. The extensible links may be of the type shown in U.S. Pat. Nos. 4,557,132, 4,766,757 and 5,353,620 incorporated herein by reference. The first member 13 having the clamping surface 14 is formed as an aluminum extrusion and includes an upper tubular portion 20 and a lower portion 21 including spaced flanges 22 engaging the free ends of lower arms 11. A plurality of longitudinally spaced projections 23 are provided at the juncture of the portion 20 which defines the clamping surface 14. Each projection 23 has a slot 24 formed therein and the slots 24 of the various projections 23 are in longitudinal alignment. Each slot 24 has its lower ends spaced from the clamping surface 14 and extends outwardly and upwardly so that its upper end is generally near the plane of the clamping surface. Each slot 24 is preferably arcuate and has a center spaced from the clamping surface and preferably extends for substantially 90°.

The bending member 16 is also in the form of an aluminum extrusion including a tubular portion 25 and a longitudinally extending leg 26 with a plurality of longitudinally spaced projections 27 having openings 28 therein. The projections 27 of the bending member 16 mesh with the projections 23 of the fixed member 13 and a pin extends through the openings 28 and slots 24 to hinge the bending member 16 to the fixed member 13. The bending member 16 further includes a portion 30 that extends upwardly and outwardly when the bending member 16 is in position for bending and has a contacting portion defined by a longitudinally extending plastic strip 31 positioned in a recess 32. The recess is generally L-shaped and the strip 31 includes a short leg 33 having an enlarged end portion 34 for holding the strip 31 and the other leg 35 thereof extends along the recess beyond the portion to define a sheet contacting portion. Strip 31 is preferably made of polyurethane having a durometer of 60 on the A scale.

The fixed member 13 further includes a recess extending longitudinally at the juncture of the clamping surface 14 and the projections 23. The recess functions as a pocket into which any burrs may fall from a knife used for scoring the workpiece. The clamping surface 14 is spaced slightly above the projections 23 in order to minimize marring of the surface of the workpiece when it is inserted and removed. The bending member 16 also includes a recess extending longitudinally between the projections 27 and the contacting portion 31. Such a bending brake is shown in U.S. Pat. No. 5,505,069 incorporated herein by reference.

In use, a workpiece of sheet material is clamped against the clamping surface 14 and the bending member 16 is moved by swinging the handle bringing the contacting portion of the bending member 16 in engagement with the sheet material. As the bending member is swung upwardly, the hinge pin 29 on the bending member 16 moves along the slots 24 and is guided in a fashion such that the contacting portion maintains substantially the same relative position of contact thereby minimizing marring of the surface of sheet material.

Figure 2:
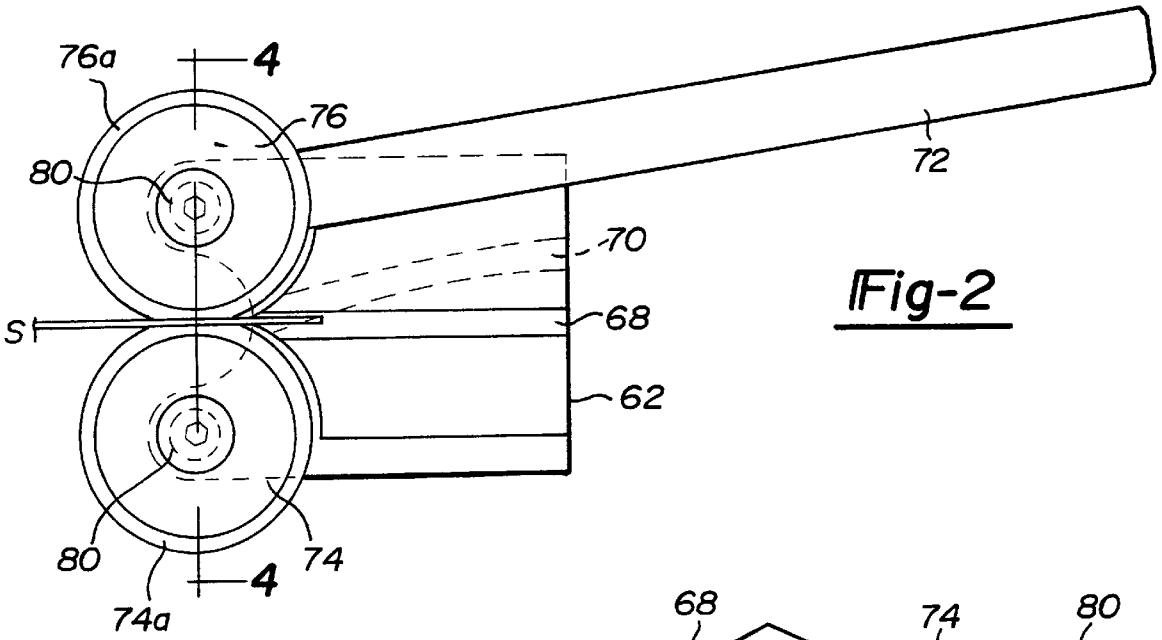
FIG. 2 is a side elevational view of a hand held cutter embodying the invention.
Figure 3:
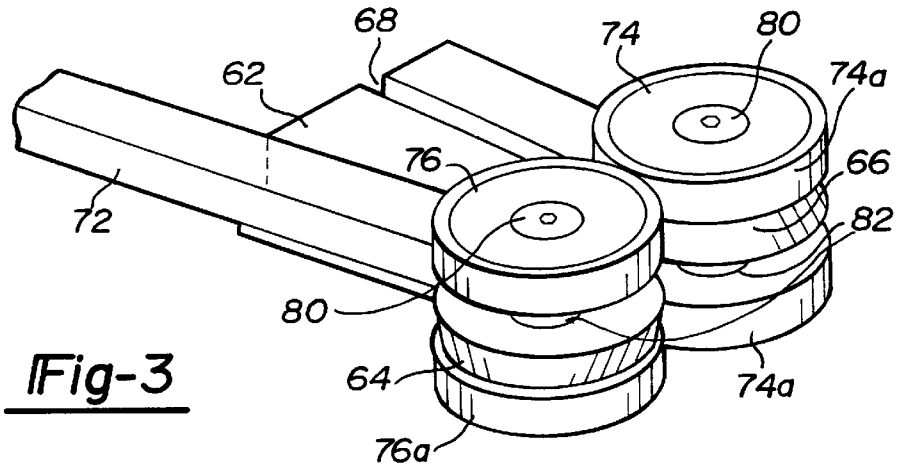
FIG. 3 is a top perspective view.
Figure 4:
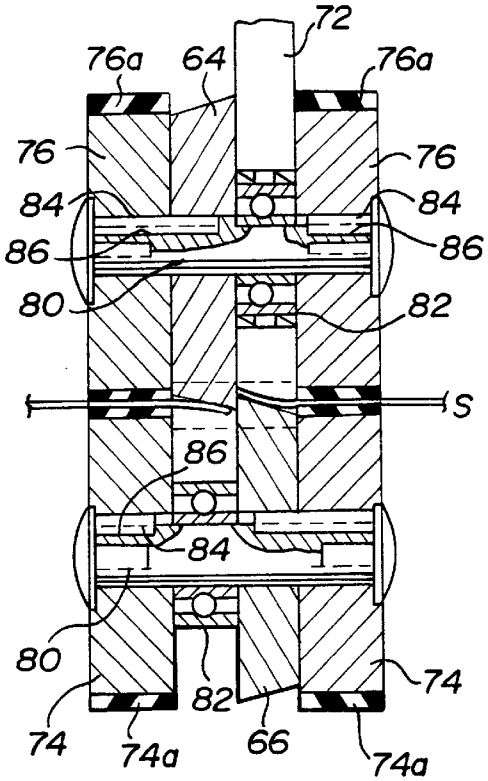
FIG. 4 is a sectional view taken along the line 4—4 in FIG. 1.
Figure 5:
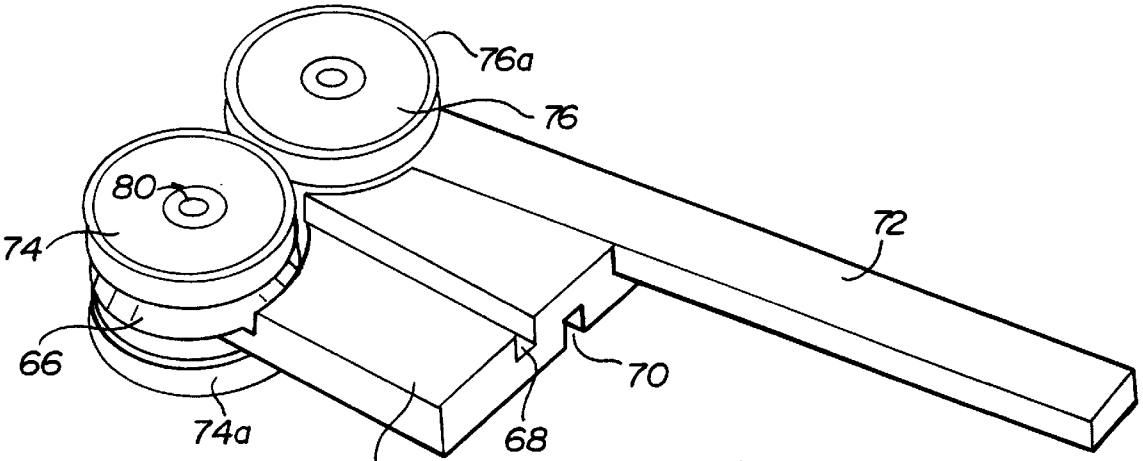
FIG. 5 is a top perspective view taken from the right in FIG. 1.

The present invention is directed to providing a hand held cutter system on a portable sheet bending brake. In FIGS. 2 and 3, the invention will be described in connection with the above described type of portable sheet bending brake or that shown in U.S. Pat. No. 4,557,132 incorporated herein by reference.

Figure 6:
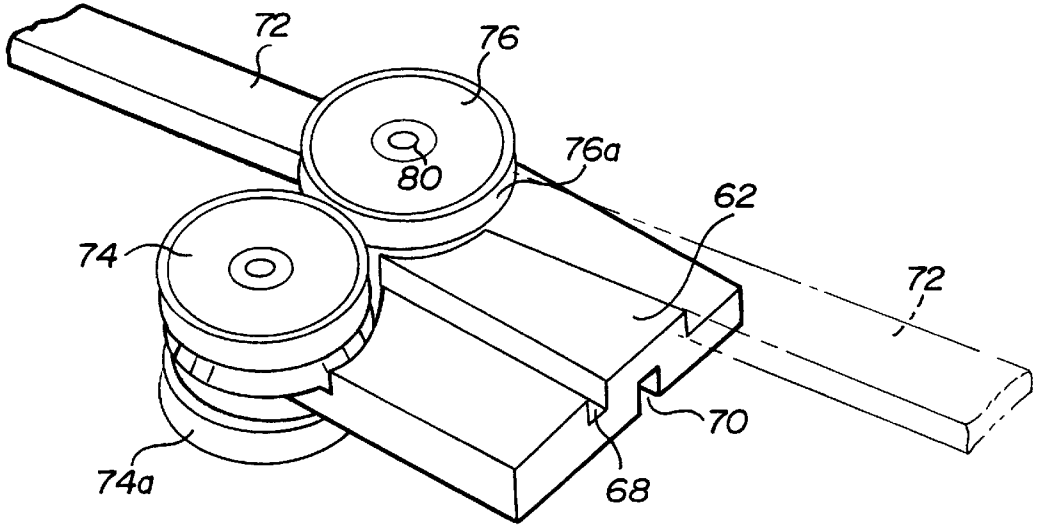
FIG. 6 is a perspective view of a modified form of hand held cutter.

Referring to FIGS. 2–5, a hand held cutter embodying the invention comprises a body 62 rotatably supporting opposed cutting rolls 64, 66. The body 62 includes guide grooves 68, 70 for guiding the severed portions of the sheet bending cut. A handle 72 is fixed to body 62 and in the position shown adapts the cutter 60 for cutting by pushing. Handle 72 can be mounted to extend in the opposite direction for cutting by pulling as shown in FIG. 6. A pair of resilient rollers 74, 76 is rotatably mounted on the same axis of each of the cutting rolls 64, 66, respectively.

Preferably each roller 74, 76 comprises a solid cylindrical metal body with a peripheral resilient cylindrical elastomeric layer 74*a,* 76*a,* respectively bonded thereto. A satisfactory material comprises urethane having a Shore hardness of 40–45 on the A scale. Each roller 74, 76 is preferably rotatably mounted on body 62 on axles 80 rotatably mounted in body 62 by the bearings 82 which also support the cutting rolls 64, 66. A key 84 and key way 86 rotatably connect rollers 74, 76 to axles 80.

When the cutter is moved across a sheet of material to be cut and the cutting rolls 64, 66 begin to cut the sheet, the resilient rollers 74, 76 frictionally engage the opposed surfaces of the sheet S and guide the cutter in a straight line.

When the operator wishes to cut a workpiece, it is first placed in the portable sheet bending brake and clamped by moving the clamping member 17 downwardly. In this position the upper surface of the clamping member is inclined toward the hinge. The operator then draws the cutter along the sheet workpiece to cut the workpiece.

In summary, in accordance with the invention, a roller with a resilient workpiece contacting surface is rotatably mounted adjacent each of the cutting rolls. When the cutting roll supporting body is pulled or pushed across a sheet to be cut, the rollers frictionally engages the upper and lower surfaces of the sheet and tend to guide the cutter in a straight line.

It can thus be seen that there has been provided a hand held cutter which at low cost; and which minimizes the problem with prior cutters.

What is claimed is:

1. A self-guiding hand-held cutter for cutting sheet metal, which comprises:

a body supporting a pair of spaced axles for rotation about parallel axes, a first pair of rollers supported on one of said axles in spaced-apart relation on opposite sides of said body and keyed to said one axle for rotating in unison with each other, each said roller having a resilient peripheral surface, a second pair of rollers supported on the other of said axles in spaced-apart relation on opposite sides of said body and keyed to said other axle for rotating in unison with each other, each said roller having a resilient peripheral surface, the resilient peripheral surface of each said roller of each said pair being opposed to the peripheral surface of the roller of the other pair on the same side of said body for frictional rolling engagement with sheet metal passed between said pairs of rollers, a cutting roll mounted on each said axle between the rollers on the associated axle, said cutting rolls being disposed on opposite sides of said body and having overlapping peripheries for cutting engagement with sheet metal passed between said cutting rolls and said pairs of rollers, each pair of rollers and each cutting roll being rotatable with the associated axle and with each other, and a handle supported on said body for manually propelling said body along a sheet of sheet metal disposed between said rollers and said cutting rolls, such that frictional engagement of said rollers with opposite sides of the sheet metal rotates said rollers, axles and cutting rolls in opposite directions for cutting the sheet metal and guiding the cutter in a straight line.

2. The cutter set forth in claim 1 wherein said body includes guide slots on opposite lateral sides thereof opening adjacent to said rollers for receiving and guiding opposed severed edges of sheet metal as the cutter is manually propelled along the sheet metal.

3. The cutter set forth is claim 1 wherein each said roller having said resilient peripheral surface comprises a metal body mounted for rotation with the associated axle and a layer of resilient material on the periphery of said metal body.

4. The cutter of claim 1, wherein each of said axles includes a key way slot and wherein said first pair of rollers each include a key received in said key way slot on said one axle and wherein said second pair of rollers each include a key received in said key way slot on said other axle.

* * * * *